United States Patent [19]

Hsu

[11] Patent Number: 4,596,525

[45] Date of Patent: Jun. 24, 1986

[54] DUAL PURPOSE LIGHTER

[76] Inventor: David Hsu, 801 Cheng Fong Bldg., No. 125, Sec. 3, Roosevelt Rd., Taipei, Taiwan

[21] Appl. No.: 693,929

[22] Filed: Jan. 23, 1985

[51] Int. Cl.[4] ..... F23Q 2/38

[52] U.S. Cl. ..... 431/124; 431/153; 431/254; 431/274; 431/277

[58] Field of Search ..... 431/124, 153, 254, 273, 431/274, 276, 277

[56] References Cited

U.S. PATENT DOCUMENTS

| | | | |
|---|---|---|---|
| 2,289,113 | 7/1942 | Florman | 431/274 X |
| 2,714,301 | 8/1955 | Beattie | 431/276 |
| 3,728,070 | 4/1973 | Rowlett | 431/276 X |
| 3,819,320 | 6/1974 | Chevallier | 431/277 X |
| 3,895,905 | 7/1975 | Nissen | 431/277 X |
| 4,253,818 | 3/1981 | Ogawa et al. | 431/274 X |
| 4,419,069 | 12/1983 | Piffath | 431/277 X |

FOREIGN PATENT DOCUMENTS

| | | | |
|---|---|---|---|
| 880669 | 6/1953 | Fed. Rep. of Germany | 431/274 |
| 2262805 | 7/1973 | Fed. Rep. of Germany | 431/277 |

*Primary Examiner*—Randall L. Green

*Attorney, Agent, or Firm*—Cushman, Darby & Cushman

[57] ABSTRACT

Cigarette type lighter has the ability to work as a conventional gas lighter or without fuel by producing cinders from a flint. A lever along the side of the lighter allows selection of mode of operation. Flints may be stored within the lighter housing.

5 Claims, 8 Drawing Figures

DUAL PURPOSE LIGHTER

The present invention relates generally to a cigarette lighter or the like and more particularly to a dual purpose lighter that is capable of using conventional gas fuel, yet also selectively capable of lighting a cigarette or providing an ignitable cinder for inducing fire to other combustible material upon exhaustion of gas fuel.

In a conventional lighter, gaseous or liquid fuel is usually contained and used, sometimes with a wick as a buring medium. Refilling is called for when the fuel exhausts. When the fuel is not available the lighter becomes temporarily useless. However, a lighter with gas fuel is an undeniable item of convenience, and the present invention of a dual purpose lighter is the result of diligent study on the subject by the present inventor.

Therefore, the main object of the present invention is to provide a dual purpose lighter, which can be selectively used with or without fuel of any conventional kind, so as to overcome the aforesaid shortcomings.

Another object of the present invention is to provide a dual purpose lighter capable of being used with or without fuel so that when refill is not available right away, or should atmospheric pressure change affect usage, the lighter is still operable with the flint-cinder system.

Other features and objects of the present invention will become apparent when detailed illustration is made with the annexed drawings, where:

Figure 2:
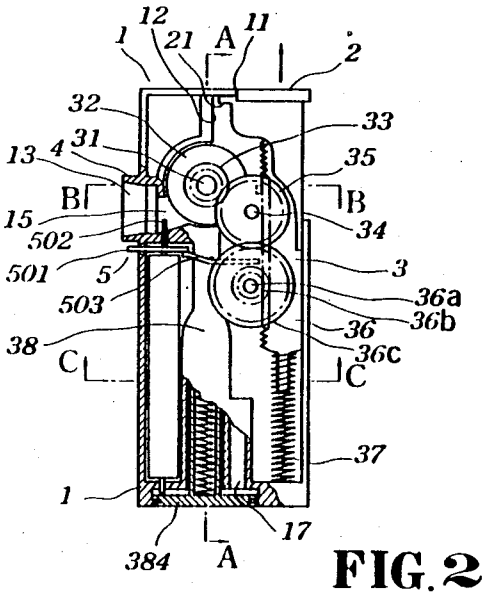
FIG. 2 is a longitudinal section of the embodiment.
Figure 3:
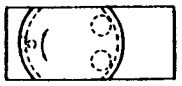
FIG. 3 is a bottom view of the same.

Now referring to the drawings, the lighter of the present invention comprises mainly a housing 1, and actuator 2, an ignition mechanism 3 contained in housing 1, covering an ignition opening lid 4 and a gas lighter ignition mechanism 5.

In this embodiment, housing 1 is generally of rectangular shape, of course other options are also possible. A cut-out 11 is provided at upper corner of the housing 1, with contained actuator 2 exposed there-through. Actuator 2 is slidable vertically up and down along the cut-out 11, the proper position of actuator 2 is assumed by an L shaped projection 21 inserted in guide channel 12 provided on top of the interpartition of housing 1. At almost the center part of the side wall opposite to the cut-out side of housing 1, ignition opening 13 is provided, behind which mechanism 3 is located. Mechanism 3 comprises a shaft 31, upon which friction wheel 32 is mounted. A pair of balancing wheels 33 are mounted along each side of friction wheel 32. Shaft 34 has two ends resting upon the walls of the housing 1, and two intermediate gears 35 mounted thereon. Gears 35 are meshed respectively with the pair of balancing wheels 33. Stem 36 is fixed within actuator 2 on a shaft and is engaged with pinion **36*a* which is mounted on shaft 36*b*. Also fixed on shaft 36*b* is a larger gear 36*c* which is meshed with one of the intermediate gears 35. Return spring 37 is provided under stem 36, while under friction wheel 32, flint device 38 is provided. Ratchet wheel 33' is provided alongside gear 36*c*, capable of moving only in one direction with downward movement of the rack 36. When stem 36 moves upward with the actuator 2, ratchet wheel 33' stands still and allows stem 36** to pass freely.

Friction wheel 32 is turned around shaft 35 at the downward snap of the user's thumb by means of the stem ratchet mechanism. Friction wheel 32 in turn produces a spark when rotated against the spring biased flint thereunder.

The flint biasing device 38 includes longitudinally disposed cylinder 14 formed in housing 1, with a pellet of flint 381 held against the under side of the friction wheel 32. The flint 381 is biased upward by spring 383 via a pin 382, and plug 384 serves to close the lower opening. Both sides of plug 384 are cut flat to match the housing sides, and grooves are formed on plug sides to facilitate quick assembling by matching the grooves and tongues on the sides of opening.

A spark passage 15 is provided between friction wheel 32 and ignition opening 13, passage 15 extending tangentially from wheel 32 toward the bottom of ignition opening 13, such that a spark produced through the friction of flint 381 against wheel 32 enters opening 13.

At another upper corner of the housing 1, a storage space 17 is provided for spare flints, which can be securely held against the upper end of lid 384.

When used with no fuel, the present invention requires only that the operator depress actuator 2, thereby moving stem 36, which actuates pinion **36*d* to rotate friction wheel 32 through larger gear 36*c*, intermediate gear 35, and balancing wheels 33. In the meantime, flint 381 produces spark instantly, the spark spits through passage 15 to reach the ignition opening 13 where the tip of a cigarette is placed to be lit, and the ignition opening 13 is already open. The release of thumb after use restores actuator 2 to its original position under the force of spring 37**.

Other than cigarette lighting, the present lighter may also be used to produce a cinder for inducing fire to other combustible material. In this application, the composition of the flint may be somewhat coarser than the ordinary ones so as to produce more cinder after several snaps of the actuator. The cinder from the coarse flint will be larger and therefore burn longer after being ejected from the lighter, so that material upon which it lands, such as a sheet of paper, will more likely catch fire.

Figure 1:
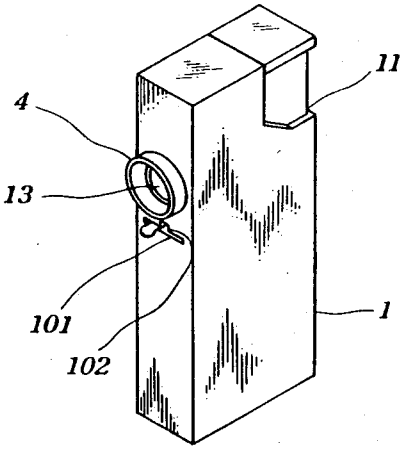
FIG. 1 is a perspective view of a preferred embodiment of the dual purpose lighter according to the present invention.
Figure 4:
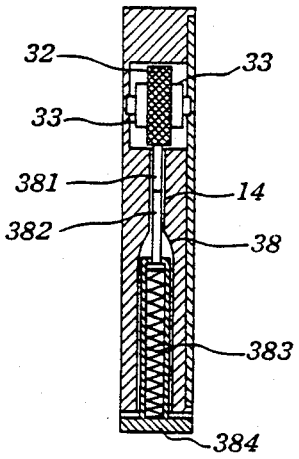
FIG. 4 is a cross-section taken along line A—A in the FIG. 2, enlarged.
Figure 5:
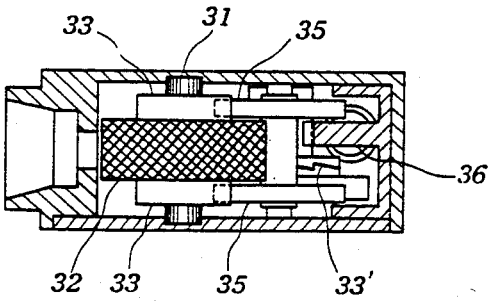
FIG. 5 is a cross-section taken along line B—B in the FIG. 2, enlarged.
Figure 6:
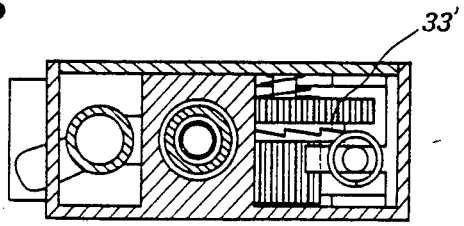
FIG. 6 is a cross-section taken along line C—C in the FIG. 2, enlarged.
Figure 7:
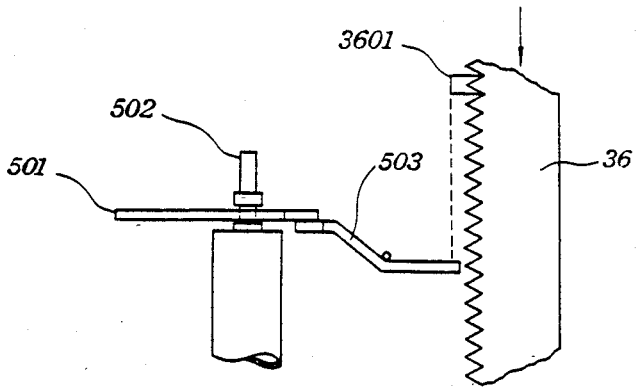
FIG. 7 is an enlarged side view showing the lever linkage system schematically.
Figure 8:
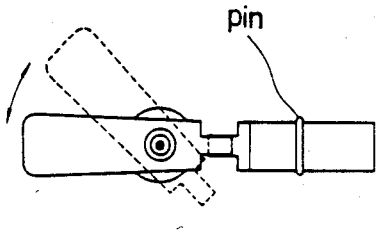
FIG. 8 is an enlarged top view showing the lever linkage system schematically.

In addition, such as shown in FIG. 2, a conventional gas lighter ignition system 5 is provided, which can be used selectively with the abovesaid flint cinder system. The system 5 comprises mainly selecting lever 501 exposed outside housing 1, pin 504 disposed alongside relaying lever 503 which is linked between selecting lever 501 and stem 36. Referring to FIGS. 7 and 8, the upper end of stem 36 is provided with projection 361, upon the downward movement of stem 36, projection 361 would contact the end of relaying lever 503 which is thereby caused to rotate about the pin 504, the other end of the lever 503 tends to rise. This said other end of the lever 503 extends to be overlapped with inner end of the selecting lever 501 which is engaged with the neck of a gas valve or nozzle 502. The outer end of the selecting lever is exposed out of the housing 1 through horizontal slot 101. As shown in FIG. 1, vertical slot 102 of a size wider than that of selecting lever 501 is further disposed upon the central portion of slot 101.

In use, selecting lever 501 is moved from its left or right position toward the center position so as to let the corresponding ends of lever 501 and relaying lever 503 to overlap, then, by pressing actuator 2, projection 361 on stem 36 contacts the corresponding end of relaying lever 503 which in turn rotates about pin 504, applying force simultaneously on selecting lever 501, forcing selecting lever 501 into slot 102. Gas is thereby released from the valve or nozzle 502 in a way similar to a conventional gas lighter and is ignited by the spark produced by the flint. Release of actuator 2 lowers selecting lever 501 to horizontal slot 101. Thereafter lever 501 may be moved to the left or right to disengage the relation between selecting lever 501 and relaying lever 503. Therefore, when the dual purpose lighter serves as a flint-cinder lighter, the gas fuel would no longer be supplied.

The lighter so constructed is very useful, since it may be used with or without fuel.

The above description is of a preferred embodiment, but modifications and changes are possible by those skilled in the art without departing from the scope and spirit of the present invention which is defined in the following claims.

I claim:

1. Dual purpose lighter capable of being used both as a conventional gas lighter as well as a flint-cinder lighter comprising:

a housing with an ignition opening therein;

means for producing cinders;

means for storing fuel;

valve means for delivering fuel from said fuel storage means to a position near said cinder producing means;

actuating means, mechanically coupled with said cinder producing means and selectively and mechanically coupled to said fuel delivery means, for producing a cinder or flame; and means for selecting use of the cinder producing means only or to allow use of the cinder producing means in combination with the fuel delivery means so that a cinder or flame is imparted through said ignition opening.

2. A lighter according to claim 1 wherein said cinder producing means comprises:

a first shaft support rotatably supporting a ratchet wheel and first gear wheel;

a second shaft support rotatably supporting a friction wheel and balancing wheel, said balancing wheel mechanically coupled to said first gear wheel;

a third shaft support rotatably supporting balancing wheels disposed along said third shaft support about a friction wheel, said balancing wheels mechanically coupled with said second gear wheel;

a flint disposed adjacent to said friction wheel and biased against said wheel by means of a spring;

a spring supported stem connecting said actuating means to said ratchet wheel such that depression of said actuating means causes said friction wheel to rotate against said flint thereby producing a cinder.

3. A lighter according to claim 1, further comprising a storage compartment in said housing to accommodate spare flints.

4. A lighter according to claim 1 wherein said selecting means comprises:

a projection coupled to said actuating means;

a relaying lever disposed within said housing in such a manner that depression of the actuating means causes said projection means to said relaying lever which is further rotatably disposed about a swivel pin;

a selecting lever connected to said fuel delivery means and disposed in such a manner that one end of said selecting lever projects outside said housing and that the other end of said selecting lever is contacted with said relaying lever, so that depression of said actuating means forces said projection means against said relaying lever, said relaying lever means contacting said selecting lever, said selecting lever means thereby by forcing said fuel delivery means to an open position.

5. A lighter according to claim 4 wherein said selecting lever is rotatably connected to said fuel delivery means so that said selecting lever means may be moved to a position unconnected to said relaying lever.

* * * * *